US006974303B2

(12) United States Patent
Wang

(10) Patent No.: US 6,974,303 B2
(45) Date of Patent: Dec. 13, 2005

(54) PUMP HAVING AN ANGLE ADJUSTABLE WATER OUTLET

(76) Inventor: Wen-Chang Wang, No. 666, Sec. 1, Chung Cheng Rd., Jen Te Hsiang, Tainan Hsien (TW)

( * ) Notice: Subject to any disclaimer, the term of this patent is extended or adjusted under 35 U.S.C. 154(b) by 67 days.

(21) Appl. No.: 10/801,346

(22) Filed: Mar. 15, 2004

(65) Prior Publication Data

US 2005/0201858 A1 Sep. 15, 2005

(51) Int. Cl.[7] ..... F04D 29/40
(52) U.S. Cl. ..... 415/126; 415/213.1; 415/214.1
(58) Field of Search ..... 415/126, 213.1, 415/214.1, 211.2

(56) References Cited

U.S. PATENT DOCUMENTS 2,849,960 A * 9/1958 Olmstead et al. ..... 415/204
6,890,149 B2 * 5/2005 Metz et al. ..... 415/126

* cited by examiner

*Primary Examiner*—Ninh H. Nguyen
(74) *Attorney, Agent, or Firm*—Alan D. Kamrath; Nikolai & Mersereau, P.A.

(57) ABSTRACT

A pump includes a main body, a water outlet connector rotatably mounted on the main body, and a positioning bar detachably mounted on the main body and rested on the water outlet connector for locking the water outlet connector on the main body. Thus, the included angle between the water outlet of the water outlet connector and the main body can be adjusted easily and conveniently without needing aid of an additional tool, thereby facilitating the user adjusting the included angle between the water outlet connector and the main body.

15 Claims, 8 Drawing Sheets

PUMP HAVING AN ANGLE ADJUSTABLE WATER OUTLET

BACKGROUND OF THE INVENTION

1. Field of the Invention

The present invention relates to a pump, and more particularly to a pump having an angle adjustable water outlet.

2. Description of the Related Art

A conventional pump in accordance with the prior art shown in FIG. 8 comprises a main body 10, a water outlet connector 20 fixed on the main body 10 by a plurality of bolts 30 and formed with a water outlet 201. When a user wishes to adjust the included angle between the water outlet 201 of the water outlet connector 20 and the main body 10, the user needs to unscrew all of the bolts 30 from the water outlet connector 20 and the main body 10. After adjustment of the included angle between the water outlet 201 of the water outlet connector 20 and the main body 10, the user needs to screw all of the bolts 30 onto the water outlet connector 20 and the main body 10 again, thereby causing inconvenience to the user. In addition, the user needs to screw all of the bolts 30 with aid of an additional tool, thereby causing inconvenience to the user. Further, the bolts 30 are easily worn out during a long-term utilization.

SUMMARY OF THE INVENTION

The primary objective of the present invention is to provide a pump having an angle adjustable water outlet.

Another objective of the present invention is to provide a pump, wherein the included angle between the water outlet of the water outlet connector and the main body can be adjusted easily and conveniently without needing aid of an additional tool, thereby facilitating the user adjusting the included angle between the water outlet connector and the main body.

A further objective of the present invention is to provide a pump, wherein the included angle between the water outlet and the main body can be adjusted arbitrarily, thereby facilitating the user operating the pump.

A further objective of the present invention is to provide a pump, wherein the water outlet connector is locked on the main body rigidly and stably by the positioning bar, so that the water outlet connector is operated smoothly without deflection due to vibration.

In accordance with the present invention, there is provided a pump, comprising:

a main body;

a water outlet connector rotatably mounted on the main body; and a positioning bar detachably mounted on the main body and rested on the water outlet connector for locking the water outlet connector on the main body.

Further benefits and advantages of the present invention will become apparent after a careful reading of the detailed description with appropriate reference to the accompanying drawings.

DETAILED DESCRIPTION OF THE INVENTION

Figure 1:
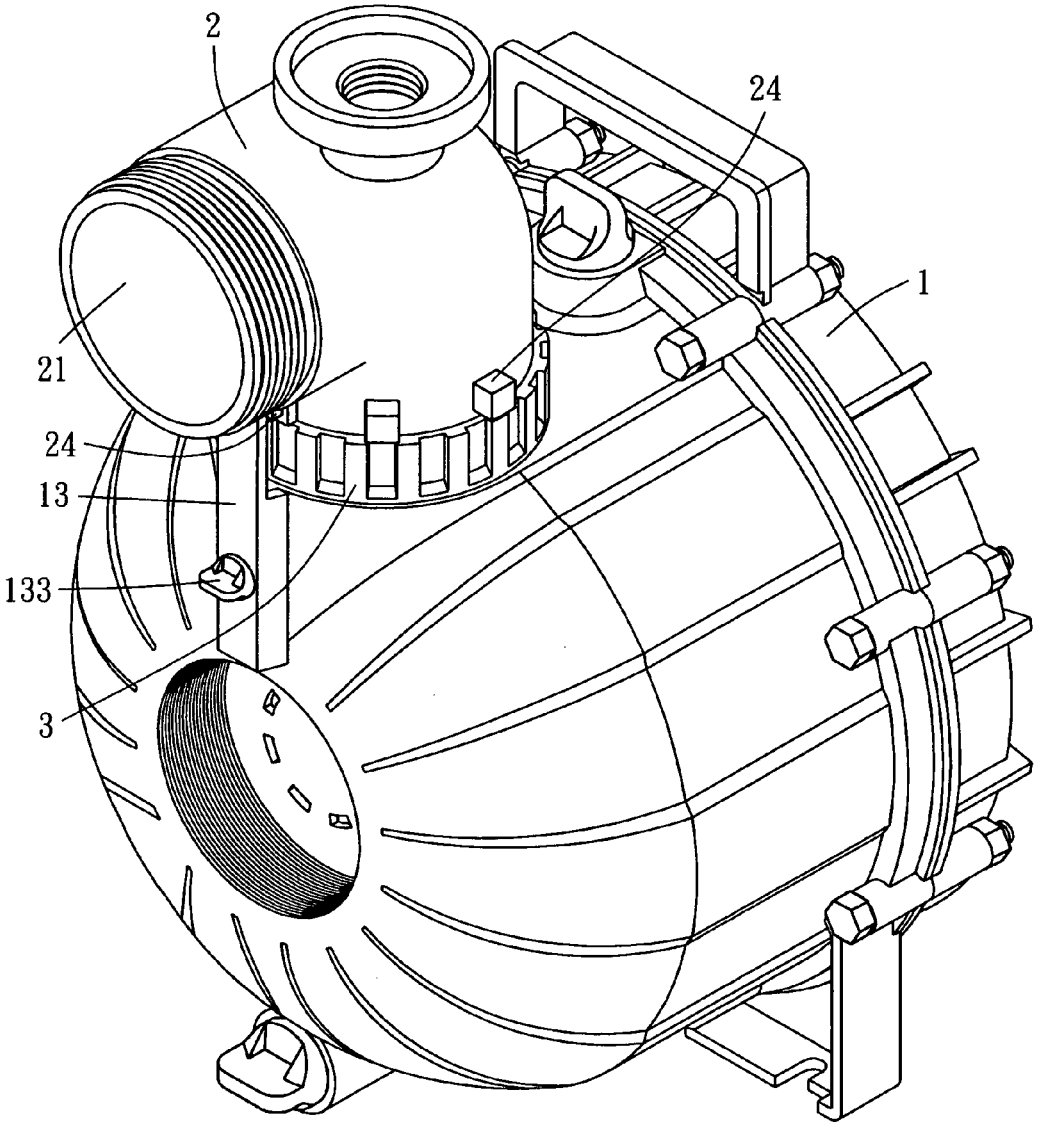
FIG. 1 is a perspective view of a pump in accordance with the preferred embodiment of the present invention.
Figure 2:
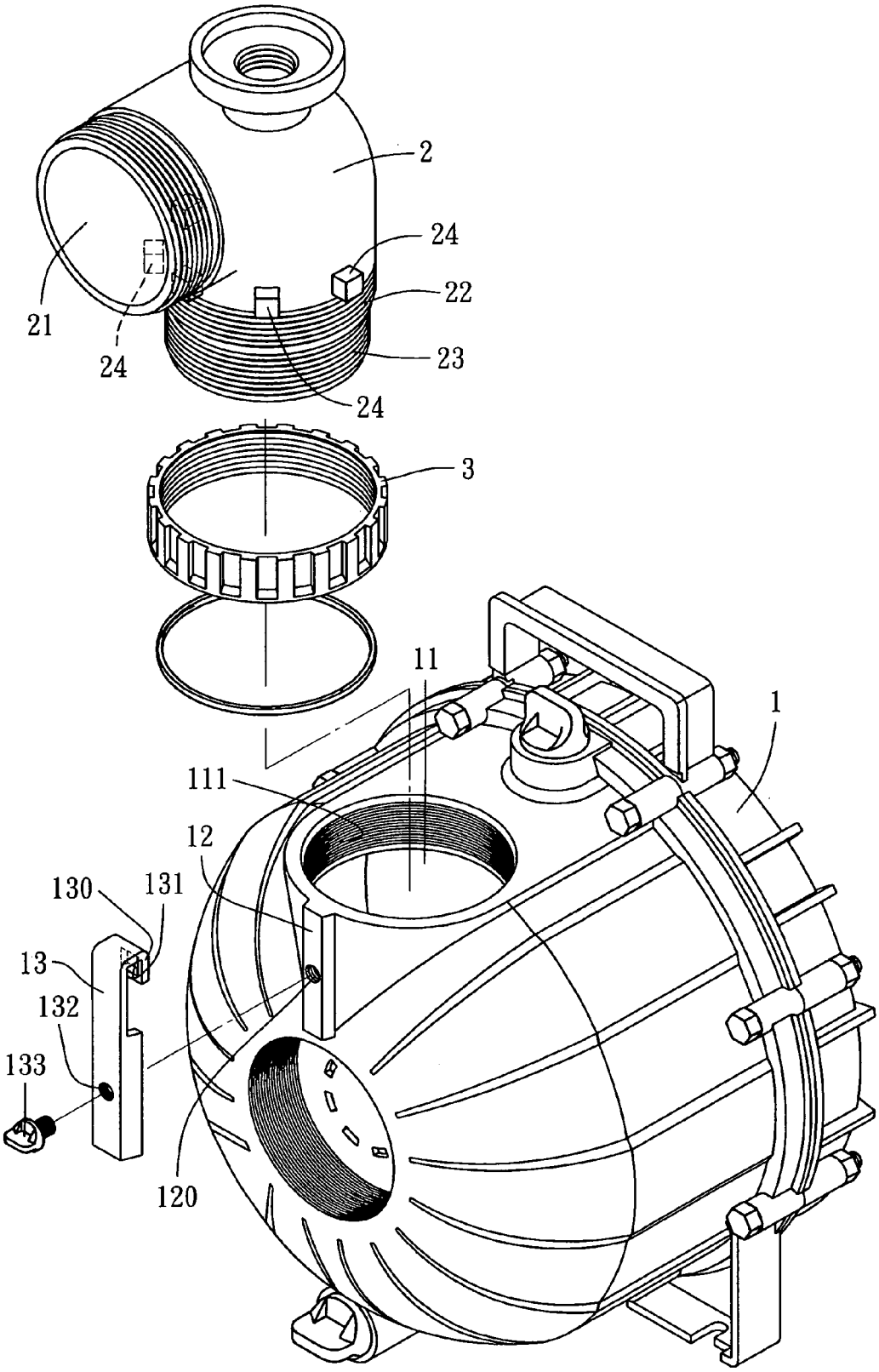
FIG. 2 is an exploded perspective view of the pump as shown in FIG. 1.
Figure 3:
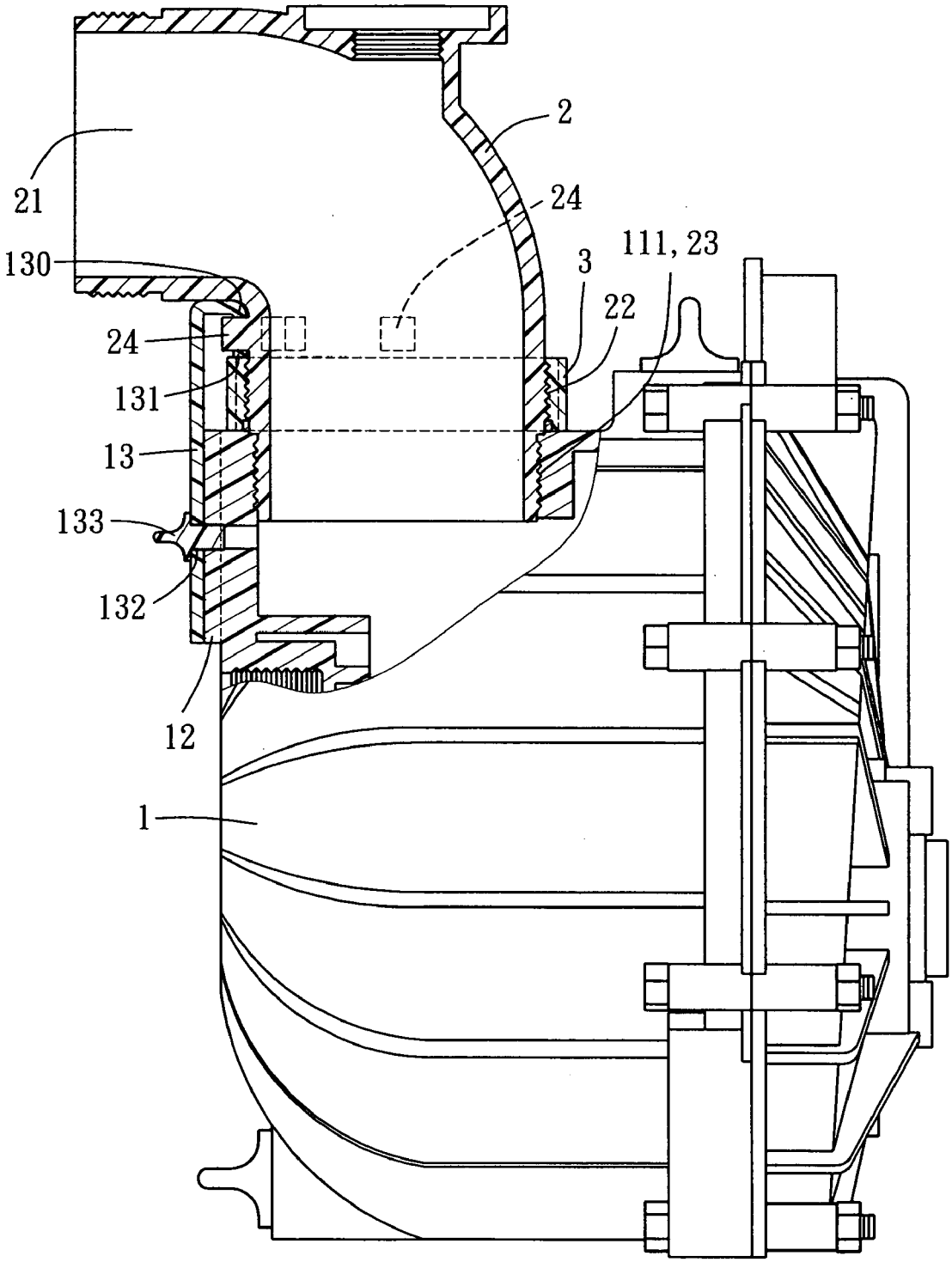
FIG. 3 is a side plan partially cross-sectional view of the pump as shown in FIG. 1.
Figure 4:
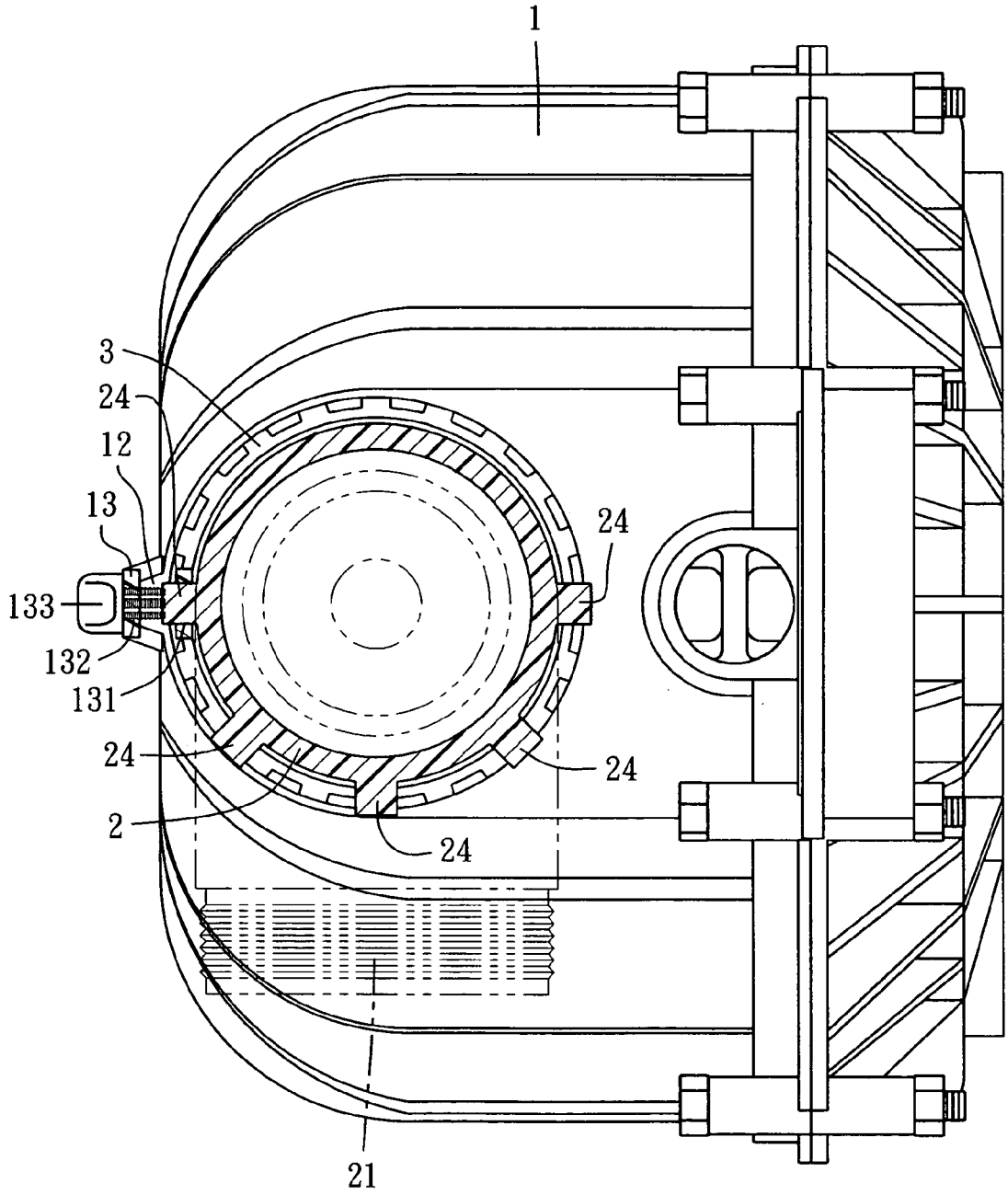
FIG. 4 is a top plan partially cross-sectional view of the pump as shown in FIG. 1.

Referring to the drawings and initially to FIGS. 1–4, a pump in accordance with the preferred embodiment of the present invention comprises a main body 1, a water outlet connector 2 rotatably mounted on the main body 1, and a positioning bar 13 detachably mounted on the main body 1 and rested on the water outlet connector 2 for locking the water outlet connector 2 on the main body 1.

The main body 1 has a top face formed with a passage 11 having a wall formed with an inner thread 111. The main body 1 has a peripheral wall integrally formed with an elongated positioning lug 12. The positioning lug 12 of the main body 1 is located adjacent to the passage 11 and is formed with a screw bore 120.

The positioning bar 13 is detachably mounted on the positioning lug 12 of the main body 1 and has a distal end formed with a substantially L-shaped locking end 130 formed with a locking hole 131. The positioning bar 13 is formed with a screw bore 132, and the pump further comprises a screw member 133 extended through the screw bore 132 of the positioning bar 13 and screwed into the screw bore 120 of the positioning lug 12 of the main body 1, so that the positioning bar 13 is secured on the positioning lug 12 of the main body 1.

The water outlet connector 2 has an inside formed with a water outlet 21. The water outlet connector 2 has a peripheral wall integrally formed with a plurality of positioning bosses 24 arranged in an annular manner and equally spaced from each other, and one of the positioning bosses 24 of the water outlet connector 2 is engaged with the locking end 130 of the positioning bar 13 and is inserted into and locked in the locking hole 131 of the locking end 130 of the positioning bar 13. The water outlet connector 2 has an end formed with a first outer thread 23 screwed into the inner thread 111 of the main body 1 for mounting the water outlet connector 2 on the main body 1 and a second outer thread 22 located above the first outer thread 23 and under the positioning bosses 24.

The pump further comprises a threaded urging cap 3 screwed onto the second outer thread 22 of the water outlet connector 2 and rested on the top face of the main body 1 for positioning the water outlet connector 2 on the main body 1 rigidly and stably.

In assembly, the threaded urging cap 3 is initially screwed onto the second outer thread 22 of the water outlet connector 2. Then, the first outer thread 23 of the water outlet connector 2 is screwed into the inner thread 111 of the main body 1 for mounting the water outlet connector 2 on the main body 1. Then, the water outlet connector 2 is rotated on the main body 1 to adjust the included angle between the water outlet connector 2 and the main body 1. Then, the urging cap 3 is rotated on the water outlet connector 2 to move downward to press the top face of the main body 1 for positioning the water outlet connector 2 on the main body 1 rigidly and stably. Then, the positioning bar 13 is mounted on the positioning lug 12 of the main body 1, with the locking hole 131 of the positioning bar 13 aligning with one of the positioning bosses 24 of the water outlet connector 2, so that one of the positioning bosses 24 of the water outlet connector 2 is inserted into the locking hole 131 of the locking end 130 of the positioning bar 13. Finally, the screw member 133 is rotated relative to the positioning bar 13 to be screwed into the screw bore 120 of the positioning lug 12 of the main body 1, so that the positioning bar 13 is secured on the positioning lug 12 of the main body 1, and one of the positioning bosses 24 of the water outlet connector 2 is locked in the locking hole 131 of the locking end 130 of the positioning bar 13, thereby locking the water outlet connector 2 on the main body 1 by the positioning bar 13.

When a user wishes to adjust the included angle between the water outlet connector 2 and the main body 1, the screw member 133 is unscrewed to release the positioning bar 13, so that the positioning bar 13 is moved outward relative to the positioning lug 12 of the main body 1 to detach one of the positioning bosses 24 of the water outlet connector 2 from the locking hole 131 of the locking end 130 of the positioning bar 13. Then, the urging cap 3 is unscrewed to release the water outlet connector 2, so that the water outlet connector 2 is rotatable relative to the main body 1 to adjust the included angle between the water outlet connector 2 and the main body 1.

After adjustment of the included angle between the water outlet connector 2 and the main body 1, the urging cap 3 is tightened to position the water outlet connector 2 on the main body 1, and the screw member 133 is screwed to tighten the positioning bar 13, so that another one of the positioning bosses 24 of the water outlet connector 2 is locked in the locking hole 131 of the locking end 130 of the positioning bar 13, thereby locking the water outlet connector 2 on the main body 1 by the positioning bar 13.

Figure 5:
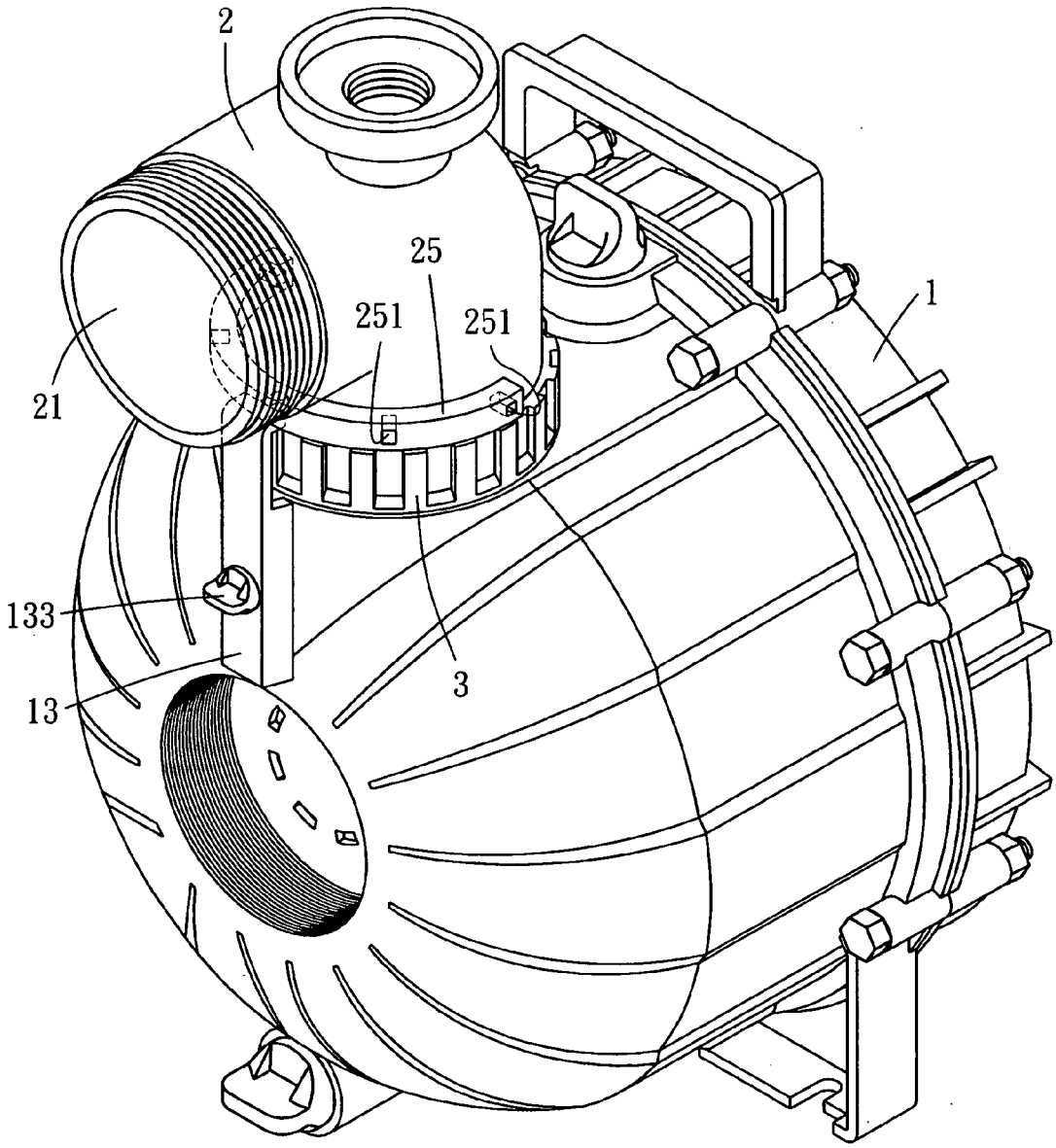
FIG. 5 is a perspective view of a pump in accordance with another embodiment of the present invention.
Figure 6:
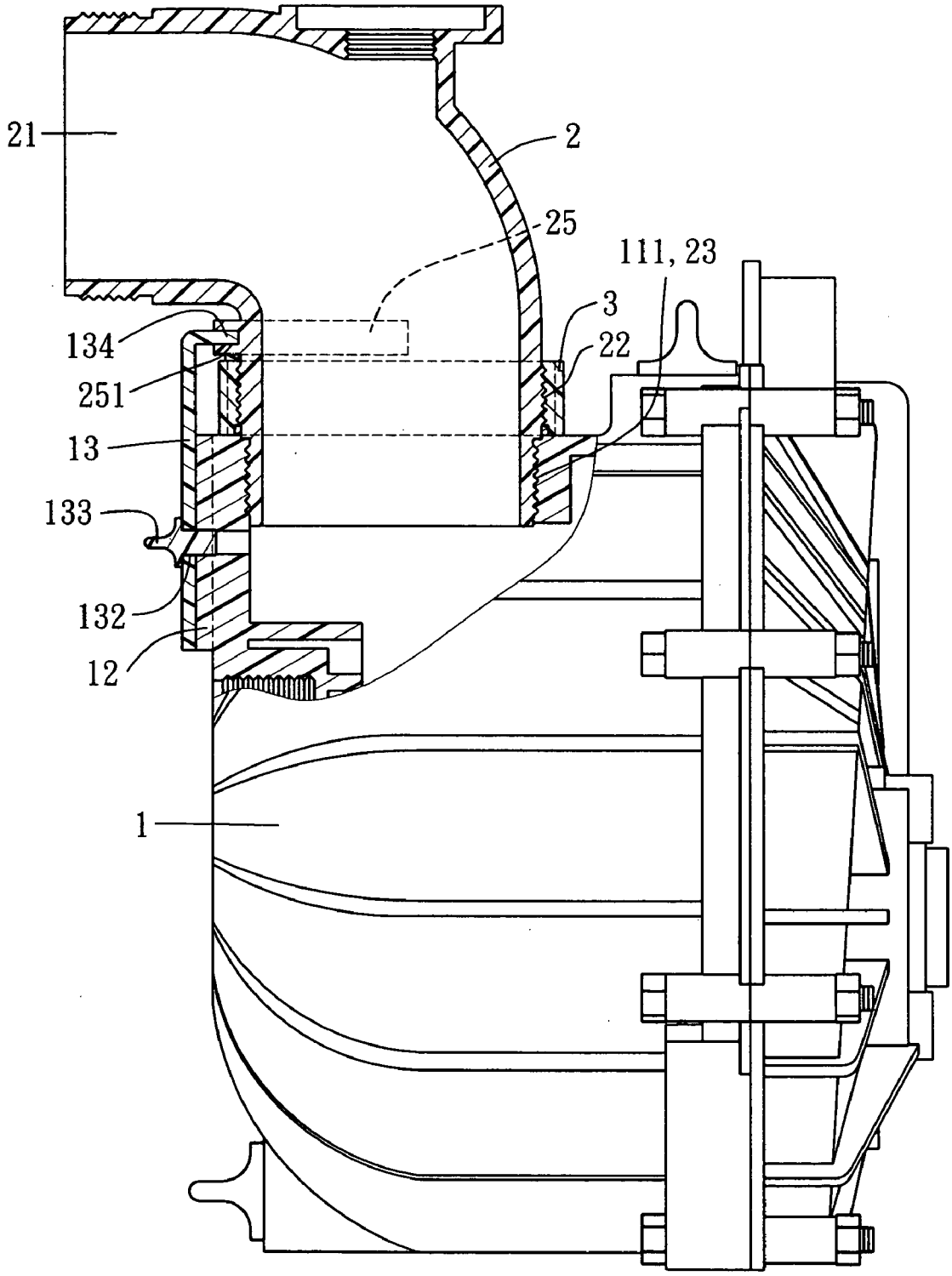
FIG. 6 is a side plan partially cross-sectional view of the pump as shown in FIG. 5.
Figure 7:
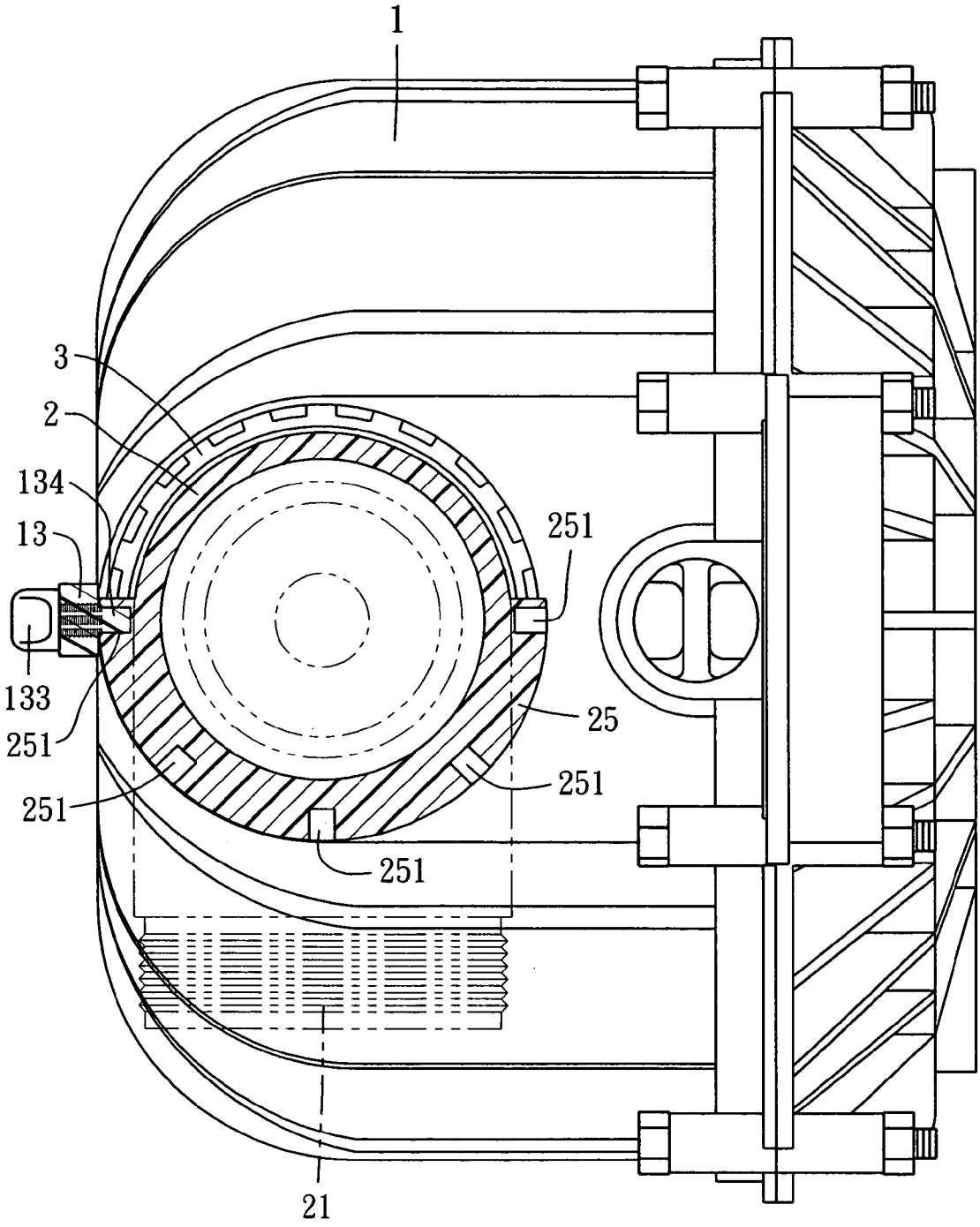
FIG. 7 is a top plan partially cross-sectional view of the pump as shown in FIG. 5.
Figure 8:
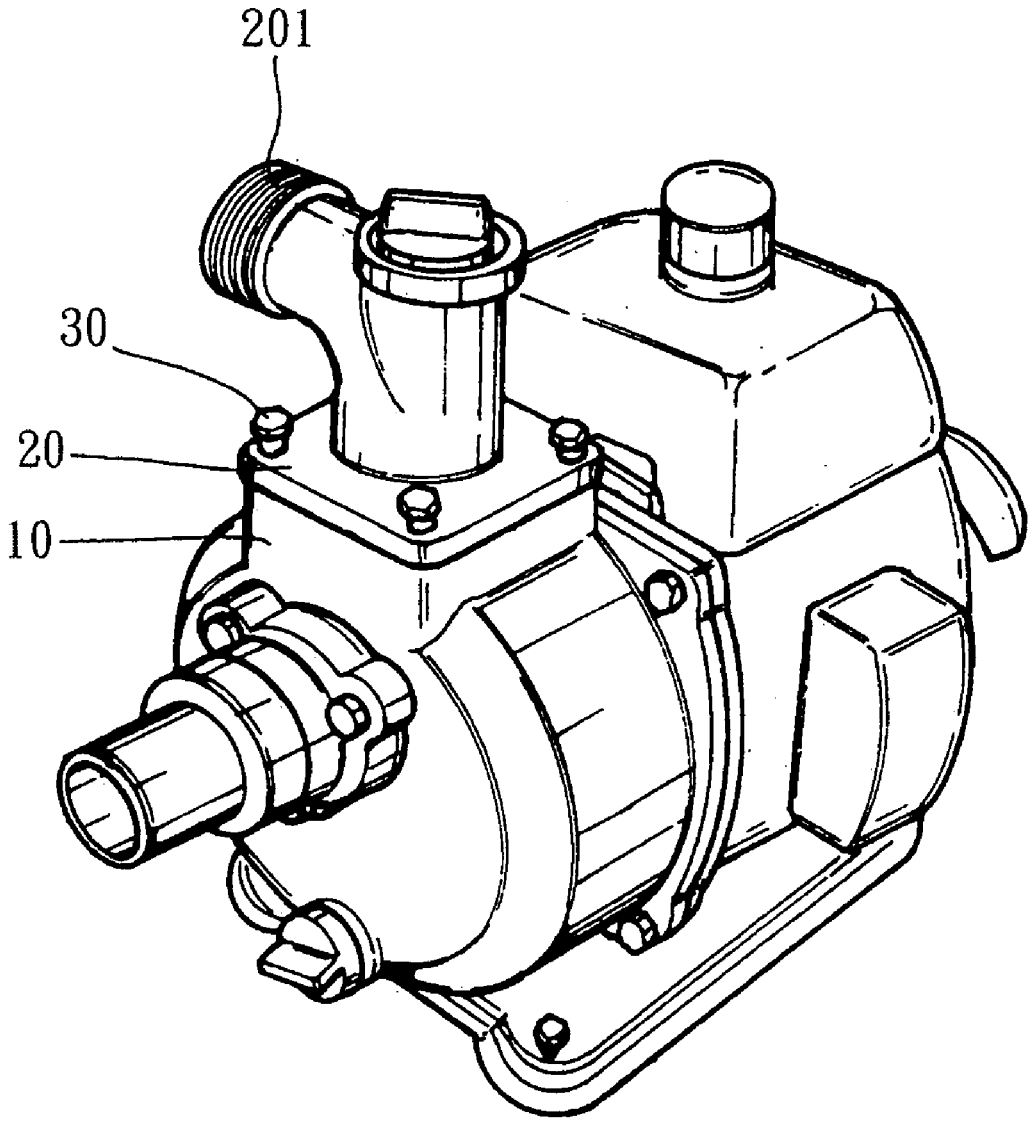
FIG. 8 (PRIOR ART)
FIG. 8 is a perspective view of a conventional pump in accordance with the prior art.

Referring to FIGS. 5–7, the water outlet connector 2 has a peripheral wall integrally formed with an arc-shaped positioning block 25 formed with a plurality of locking recesses 251, and the positioning bar 13 has a bent distal end formed with a locking end 134 (see FIG. 6) engaged with the positioning block 25 of the water outlet connector 2 and inserted into and locked in one of the locking recesses 251 of the water outlet connector 2, so that the water outlet connector 2 is locked on the main body 1 by the positioning bar 13.

Accordingly, the included angle between the water outlet 21 of the water outlet connector 2 and the main body 1 can be adjusted easily and conveniently without needing aid of an additional tool, thereby facilitating the user adjusting the included angle between the water outlet connector 2 and the main body 1. In addition, the included angle between the water outlet 21 of the water outlet connector 2 and the main body 1 can be adjusted arbitrarily, thereby facilitating the user operating the pump. Further, the water outlet connector 2 is locked on the main body 1 rigidly and stably by the positioning bar 13, so that the water outlet connector 2 is operated smoothly without deviation due to vibration.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pump, comprising:

a main body;

a water outlet connector rotatably mounted on the main body; and a positioning bar detachably mounted on the main body and rested on the water outlet connector for locking the water outlet connector on the main body.

2. The pump in accordance with claim 1, wherein the positioning bar has a distal end formed with a locking hole, the water outlet connector has a peripheral wall integrally formed with a plurality of positioning bosses, and one of the positioning bosses of the water outlet connector is locked in the locking hole of the positioning bar.

3. The pump in accordance with claim 2, wherein the positioning bosses are arranged in an annular manner.

4. The pump in accordance with claim 2, wherein the positioning bosses are equally spaced from each other.

5. The pump in accordance with claim 2, wherein the distal end of the positioning bar is formed with a bent locking end, and the locking hole is formed in the locking end.

6. The pump in accordance with claim 5, wherein the locking end of the positioning bar is substantially L-shaped.

7. The pump in accordance with claim 1, wherein the water outlet connector has an inside formed with a water outlet.

8. The pump in accordance with claim 1, wherein the main body has a top face formed with a passage having a wall formed with an inner thread, the water outlet connector has an end formed with a first outer thread screwed into the inner thread of the main body for mounting the water outlet connector on the main body.

9. The pump in accordance with claim 8, wherein the end of the water outlet connector is formed with a second outer thread, and the pump further comprises a threaded urging cap screwed onto the second outer thread of the water outlet connector and rested on the top face of the main body for positioning the water outlet connector on the main body.

10. The pump in accordance with claim 9, wherein the second outer thread is located above the first outer thread.

11. The pump in accordance with claim 1, wherein the main body has a peripheral wall integrally formed with an elongated positioning lug, and the positioning bar is detachably mounted on the positioning lug of the main body.

12. The pump in accordance with claim 11, wherein the positioning lug of the main body is formed with a screw bore, the positioning bar is formed with a screw bore, and the pump further comprises a screw member extended through the screw bore of the positioning bar and screwed into the screw bore of the positioning lug of the main body, so that the positioning bar is secured on the positioning lug of the main body.

13. The pump in accordance with claim 1, wherein the water outlet connector has a peripheral wall formed with a plurality of locking recesses, and the positioning bar has a bent distal end formed with a locking end locked in one of the locking recesses of the water outlet connector, so that the water outlet connector is locked on the main body by the positioning bar.

14. The pump in accordance with claim 13, wherein the peripheral wall of the water outlet connector is integrally formed with a positioning block, and the locking recesses are formed in the positioning block.

15. The pump in accordance with claim 14, wherein the positioning block of the water outlet connector is substantially arc-shaped.

* * * * *